US008068076B2

(12) United States Patent
Kurosawa

(10) Patent No.: US 8,068,076 B2
(45) Date of Patent: Nov. 29, 2011

(54) LIQUID CRYSTAL DISPLAY APPARATUS

(75) Inventor: Teppei Kurosawa, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 762 days.

(21) Appl. No.: 12/113,355

(22) Filed: May 1, 2008

(65) Prior Publication Data

US 2008/0273129 A1 Nov. 6, 2008

(30) Foreign Application Priority Data

May 2, 2007 (JP) ..... 2007-121661

(51) Int. Cl.
*G09G 3/36* (2006.01)

(52) U.S. Cl. ..... 345/87; 345/96

(58) Field of Classification Search ..... 345/87–104, 345/204, 211–213
See application file for complete search history.

(56) References Cited

U.S. PATENT DOCUMENTS

| | | | | |
|---|---|---|---|---|
| 6,989,812 | B2 * | 1/2006 | Arimoto et al. | 345/98 |
| 7,277,092 | B2 * | 10/2007 | Shen et al. | 345/204 |
| 7,701,426 | B2 * | 4/2010 | Yokoyama et al. | 345/87 |
| 2002/0140691 | A1 * | 10/2002 | Sato et al. | 345/212 |
| 2003/0058264 | A1 | 3/2003 | Takako et al. | |
| 2006/0125810 | A1 * | 6/2006 | Lee | 345/204 |
| 2007/0097054 | A1 * | 5/2007 | Cheng | 345/96 |
| 2008/0165108 | A1 * | 7/2008 | Shen et al. | 345/94 |
| 2008/0252583 | A1 * | 10/2008 | Sakashita et al. | 345/90 |

FOREIGN PATENT DOCUMENTS

| | | | |
|---|---|---|---|
| EP | 1669975 | A3 | 6/2006 |
| JP | 3407698 | A | 2/2001 |
| WO | 92/21123 | A1 | 11/1992 |
| WO | 2006030388 | A3 | 3/2006 |

* cited by examiner

*Primary Examiner* — Jimmy H Nguyen
(74) *Attorney, Agent, or Firm* — Canon U.S.A., Inc. IP Division

(57) ABSTRACT

A liquid crystal display apparatus includes a liquid crystal modulation element having a liquid crystal layer and first and second electrodes, and a controller performs control for an electric potential difference applied between the electrodes such that an electric field applied to the liquid crystal layer is inverted between positive and negative. The controller switches the control between first control and second control. The first control controls the electric potential difference such that one of an absolute value of a time-integrated value of the positive electric field applied to the liquid crystal layer and an absolute value of a time-integrated value of the negative electric field applied thereto is larger than the other, and the second control controls the electric potential difference such that the other absolute value of the time-integrated value is larger than the one absolute value of the time-integrated value.

6 Claims, 10 Drawing Sheets

LIQUID CRYSTAL DISPLAY APPARATUS

BACKGROUND OF THE INVENTION

The present invention relates to a liquid crystal display apparatus using a liquid crystal modulation element such as a liquid crystal projector and performing liquid crystal drive control such as overdrive for improving moving image display performance.

Some of the liquid crystal modulation elements (also called as liquid crystal display elements) are realized by sealing nematic liquid crystal having positive dielectric anisotropy between a first transparent substrate having a transparent electrode (common electrode) formed thereon and a second transparent substrate having a transparent electrode (pixel electrode) forming pixels, wiring, switching elements and the like formed thereon.

The liquid crystal modulation element is referred to as a Twisted Nematic (TN) liquid crystal modulation element in which the major axes of liquid crystal molecules are twisted by 90 degrees continuously between the two glass substrates. This liquid crystal modulation element is used as a transmissive liquid crystal modulation element. Some of the liquid crystal modulation elements utilize a circuit substrate having reflecting mirrors, wiring, switching elements and the like formed thereon instead of the abovementioned second transparent substrate. This is called a Vertical Aligned Nematic (VAN) liquid crystal modulation element in which the major axes of liquid crystal molecules are alignment in homeotropic alignment substantially perpendicularly to two substrates. The liquid crystal modulation element is used as a reflective liquid crystal modulation element.

In these liquid crystal modulation elements, typically, Electrically Controlled Birefringence (ECB) effect is used to provide retardation for a light wave passing through a liquid crystal layer to control the change of polarization of the light wave, thereby forming an image from the light.

In the liquid crystal modulation element, which utilizes the ECB effect to modulate the light intensity, application of an electric field to the liquid crystal layer moves ionic materials present in the liquid crystal layer. When a DC electric field is continuously applied to the liquid crystal layer, the ionic materials are pulled toward one of two opposite electrodes. Even when a constant voltage is applied to the electrodes, the electric field applied to the liquid crystal layer is cancelled out by the charged ions to substantially attenuate the electric field applied to the liquid crystal layer.

To avoid such a phenomenon, a line inversion drive method is typically employed in which the polarity of an applied electric field is reversed between positive and negative for each line of arranged pixels and is changed in a predetermined cycle such as 60 Hz or the like. In addition, a field inversion drive method is used in which the polarity of an applied electric field to all of arranged pixels is reversed between positive and negative in a predetermined cycle. Those drive methods can avoid the application of the electric field of only one polarity to the liquid crystal layer to prevent the unbalanced ions. This corresponds to controlling the effective electric field to be applied to the liquid crystal layer such that it always has the same value as the voltage to be applied to the electrodes.

So-called overdrive has been known as a drive method for the purpose of improving the display quality of the liquid crystal modulation element. In the overdrive, when the liquid crystal modulation element is driven so as to display a moving image whose tone (or tone value) changes with time, the tone values of two field images that are temporally continuous are compared. When the tone value increases, the liquid crystal modulation element is driven with an increased tone value that is higher than an original display tone value. When the tone value decreases on the other hand, the liquid crystal modulation element is driven with a decreased tone value that is lower than the original display tone value. The use of such overdrive as described above improves the response speed of the liquid crystal in a halftone (middle tone) display state, and thereby blur of a displayed moving image is reduced.

The overdrive of the liquid crystal modulation element has been disclosed in, for example, Japanese Patent Laid-Open No. 2001-034238 (Japanese Patent No. 3407698).

However, the overdrive to display the moving image on the liquid crystal modulation element for a long time results in application of a DC voltage component to a liquid crystal layer thereof in average. This is because the absolute values of liquid crystal applied electric fields (hereinafter also simply referred to as voltages) corresponding to positive and negative overdrive amounts in a certain tone are unbalanced.

For example, a case is assumed where a black display state and a certain halftone display state are cyclically switched. In this case, the voltage corresponding to a certain overdrive amount is applied to the liquid crystal layer in the switching from the black display state in which no voltage is applied to the liquid crystal layer to the halftone display state. On the other hand, the voltage corresponding to the overdrive amount is zero in the switching from the halftone display state to the black display state. When such unbalanced voltages applied to the liquid crystal layer are frequently caused in, for example, moving image display performed by continuously scanning a stripe pattern image, and then the voltage component corresponding to the difference of the unbalanced voltages is accumulated, the DC voltage component is applied to the liquid crystal layer.

In a conventional direct-view-type liquid crystal panel, line inversion drive is employed in which voltages having opposite polarities to each other are applied to each of adjacent lines of display electrodes formed in the liquid crystal modulation element as a countermeasure against the application of the DC voltage component to the liquid crystal layer. Alternatively, dot inversion drive is also employed where voltages having opposite polarities to each other are applied to each of adjacent pixels.

These drive methods can balance out the DC voltage components in the adjacent lines or pixels.

In a liquid crystal display apparatus such as an image projection apparatus using a micro display, however, the line inversion drive and the dot inversion drive cause an abnormal alignment of the liquid crystal which provides an adverse influence on a displayed image. To prevent this, the field inversion drive is recently used in which one field is driven with a single polarity. However, the field inversion drive cannot suppress the application of the DC voltage component to the liquid crystal layer in the overdrive.

Japanese Patent No. 3407698 has disclosed a method that appropriate selection of the material of the electrodes can solve a problem in which a so-called "stain" caused due to the application of the DC voltage component to the liquid crystal layer in the overdrive.

However, the problem caused by the application of the DC voltage component to the liquid crystal layer is not limited to the "stain" described in Japanese Patent No. 3407698. Specifically, burn-in or flicker is also caused. Thus, the application of the DC voltage component to the liquid crystal layer must be prevented essentially.

BRIEF SUMMARY OF THE INVENTION

The present invention provides a liquid crystal display apparatus that can eliminate the application of the DC voltage component to the liquid crystal layer due to the unbalanced liquid crystal applied voltages caused in a single direction for a long time to effectively suppress a phenomenon causing a deteriorated display quality (e.g., burn-in, flicker).

The present invention, according to an aspect thereof, provides a liquid crystal display apparatus including a liquid crystal modulation element in which a liquid crystal layer is provided between a first electrode and a second electrode, and a controller configured to perform control for an electric potential difference applied between the first and second electrodes such that an electric field applied to the liquid crystal layer is inverted between positive and negative. The controller switches the control between first control and second control. The first control controls the electric potential difference such that one of an absolute value of a time-integrated value of the positive electric field applied to the liquid crystal layer and an absolute value of a time-integrated value of the negative electric field applied thereto is larger than the other, and the second control controls the electric potential difference such that the other absolute value of the time-integrated value is larger than the one absolute value of the time-integrated value.

The present invention, according to another aspect thereof, provides a liquid crystal display apparatus including a liquid crystal modulation element in which a liquid crystal layer is provided between a first electrode and a second electrode, and a controller configured to perform control for an electric potential difference applied between the first and second electrodes such that an electric field applied to the liquid crystal layer is inverted between positive and negative. The controller switches the control between first control and second control. The first control applies a positive voltage to the liquid crystal layer based on an image signal corresponding to one frame to write thereto an image corresponding to the one field and then applying a negative voltage to the liquid crystal layer based on the image signal corresponding to the one frame to write thereto another image corresponding to the one field, and a second control applies a negative voltage to the liquid crystal layer based on the image signal corresponding to the one frame to write thereto an image corresponding to the one field and then applying a positive voltage to the liquid crystal layer based on the image signal corresponding to the one frame to write thereto another image corresponding to the one field. The first control performs overdrive when the positive voltage is applied to the liquid crystal layer, and the second control performs the overdrive when the negative voltage is applied to the liquid crystal layer.

The present invention, according to still another aspect thereof, provides an image display system including the above-described liquid crystal display apparatus and an image supply apparatus that supplies image information to the liquid crystal display apparatus.

Other aspects of the present invention will become apparent from the following description and the attached drawings.

DETAILED DESCRIPTION OF THE PREFERRED EMBODIMENTS

Exemplary embodiments of the present invention will hereinafter be described with reference to the accompanying drawings.

Embodiment 1

Figure 8:
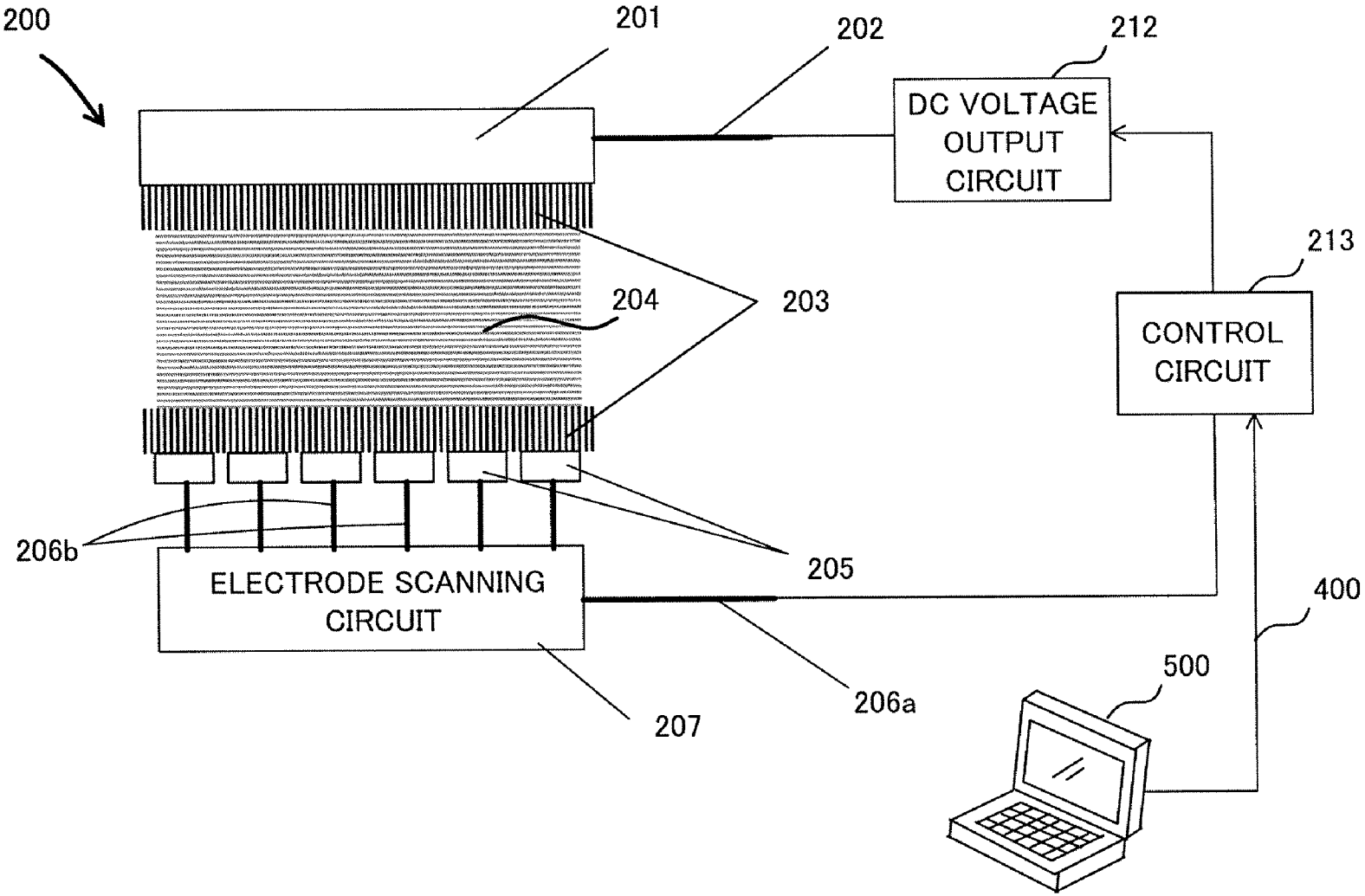
FIG. 8 is a block diagram illustrating the configuration of the liquid crystal display apparatus of Embodiment 1.

FIG. 8 schematically shows the configuration of a liquid crystal display apparatus that is a first embodiment (Embodiment 1) of the present invention.

Reference numeral 200 denotes a liquid crystal modulation element. The liquid crystal modulation element 200 has electrodes 201 and 205 arranged to be opposed to each other and a liquid crystal layer 204 provided between these electrodes 201 and 205. Alignment films 203 are provided between the electrodes 201 or 205 and the liquid crystal layer 204 to control liquid-crystal molecular alignment (orientation).

A plurality of pixel electrodes (second electrode) 205 has a pixel structure to display image information. The respective pixel electrodes 205 are connected to an electrode scanning circuit 207 via signal lines 206*b* . The electrode scanning circuit 207 receives a control signal from a control circuit 213 via a signal line 206*a* . The electrode scanning circuit 207 supplies alternating drive voltages to the respective pixel electrodes 205 via the signal lines 206*b* , based on the control signal.

The control circuit 213 receives an image signal (image information) 400 supplied from an image supply apparatus 500 (e.g., personal computer, DVD player, television tuner). The control circuit 213 outputs the control signal based on the image signal 400 to the electrode scanning circuit 207. The image supply apparatus 500 and the liquid crystal display apparatus constitute an image display system.

The electrode (first electrode) 201 is a common electrode commonly used to the plurality of pixel electrodes 205. A DC voltage that is a common voltage generated by a DC voltage output circuit 212 is supplied to the electrode 201 via a signal line 202. The operation of the DC voltage output circuit 212 is controlled by the control circuit 213.

While the DC voltage is applied to the common electrode 201, the drive voltage according to a tone value of the image signal 400 is applied to each pixel electrode 205. As a result, in the liquid crystal layer 204 an electric field depending on an electric potential difference between the electrodes 201 and 205 is generated. Liquid crystals in the liquid crystal layer 204 are driven according to the magnitude of the electric field.

In this embodiment, although will be described later in detail, the electric potential difference between the electrodes 201 and 205 (i.e., alternating drive voltage) is controlled so that an alternating electric field which inverts between positive and negative with respect to a center electric potential corresponding to the common voltage is applied to the liquid crystal layer 204.

When the liquid crystal modulation element 200 is a reflective liquid crystal modulation element, the common electrode 201 corresponds to a so-called ITO transparent electrode made by an Indium Tin Oxide film (ITO film) and the pixel electrodes 205 correspond to so-called metal mirror electrodes made of aluminum or the like. However, an alternative embodiment of the present invention may use a liquid crystal modulation element other than the reflective liquid crystal modulation element.

Figure 1A:
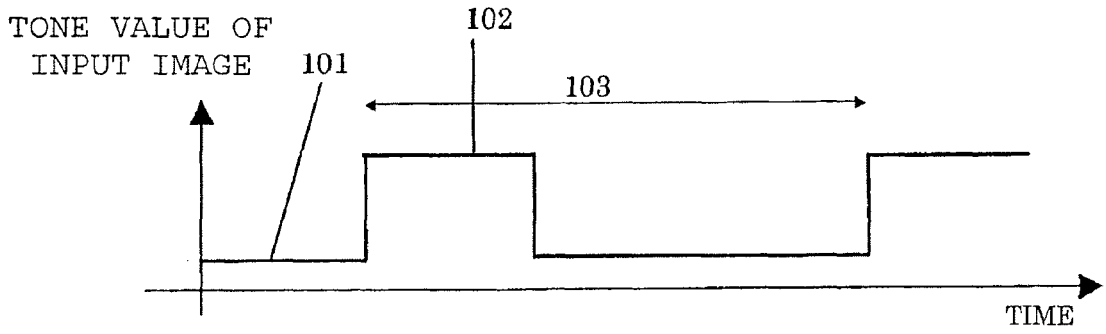
FIG. 1A illustrates a change with time of a tone value of an image signal input to the liquid crystal display apparatus from outside in a first embodiment (Embodiment 1) of the present invention.

Next, description will be made of a liquid crystal drive method in this embodiment. FIG. 1A illustrates a change with time of an image tone signal for one pixel in the liquid crystal modulation element 200. As shown in FIG. 1A, the image tone signal changes between a tone value 101 and a tone value 102 with a period 103.

Figure 1B:
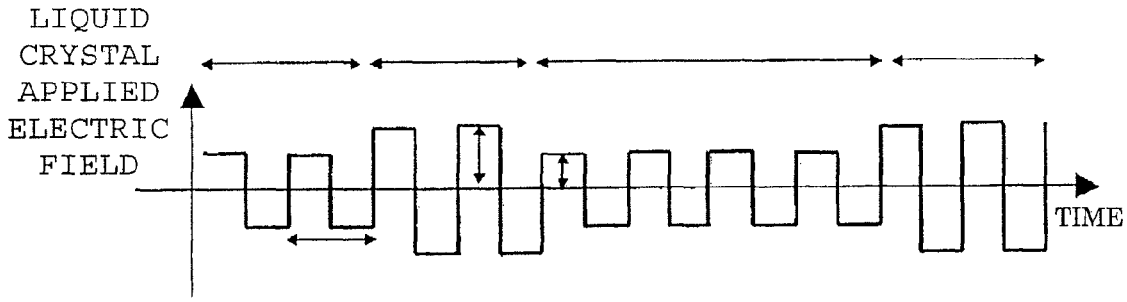
FIG. 1B illustrates field inversion drive (inversion between positive and negative) of the liquid crystal display apparatus.

The alternating electric field as shown in FIG. 1B is applied to part of the liquid crystal layer 204 corresponding to the one pixel. This alternating electric field has a frequency two times higher than a frequency of 60 Hz of a normal input image signal (which is based on the NTSC format, or 50 Hz based on the PAL format). That is, positive and negative electric fields switching at 120 Hz (or at 100 Hz) is applied to the liquid crystal layer 204.

Every time the positive or negative electric field is applied to the liquid crystal layer 204, an image (field image) is written to the liquid crystal modulation element 200. The positive electric field (voltage) may be provided by causing the common electrode 201 (electrode into or from which light enters or emerges) to be positive with respect to the pixel electrodes 205 (electrodes on which light is reflected), or the reverse configuration also may be used. Thus, the negative electric field (voltage) may be opposite to the positive electric field.

In this embodiment, a period at 60 Hz identical to the period of the input image signal is called as a frame period, and a period at 120 Hz (scanning frequency) that is an inversion period of the positive and negative electric fields is called as a field period. Two fields (field images) constitute one frame (frame image). In the following description, the electric field applied to the liquid crystal layer 204 is called as the liquid crystal applied voltage.

Figure 1C:
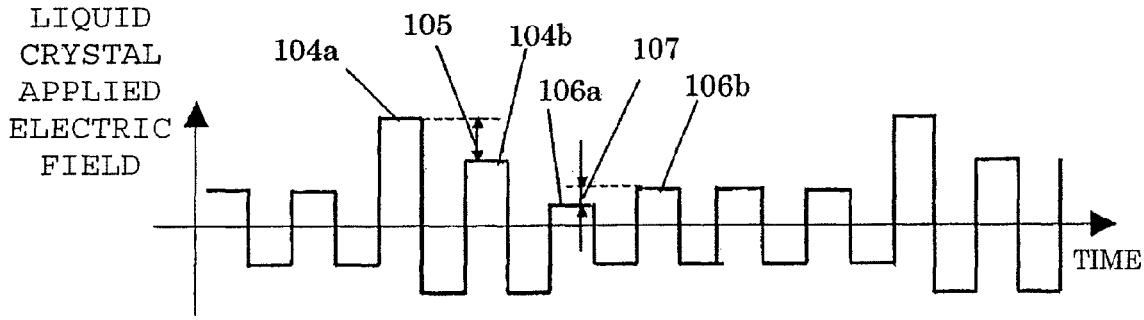
FIG. 1C illustrates first overdrive control in Embodiment 1.
Figure 1D:
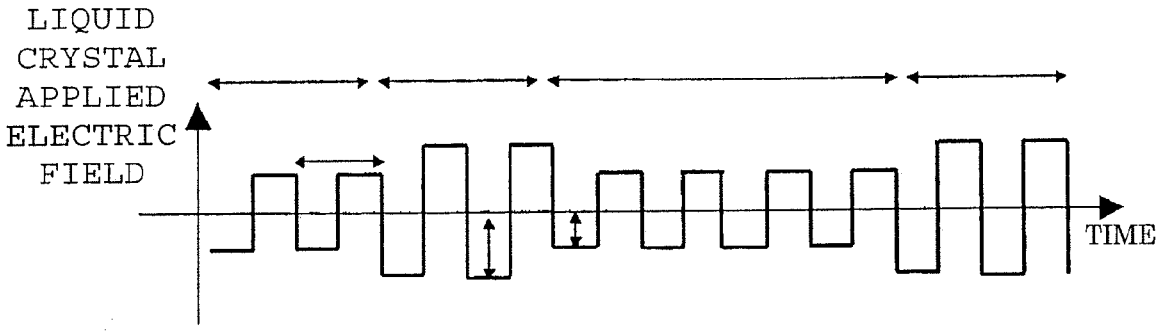
FIG. 1D illustrates the field inversion drive (inversion between negative and positive) of the liquid crystal display apparatus.
Figure 1E:
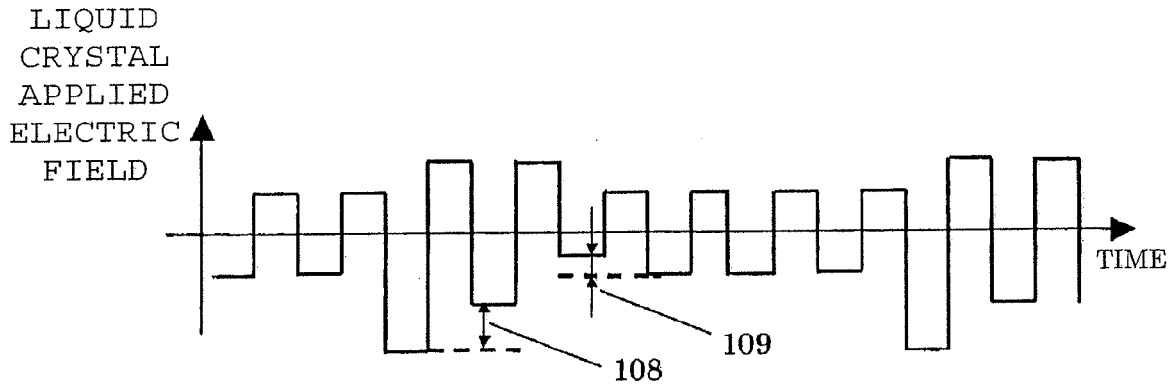
FIG. 1E illustrates second overdrive control in Embodiment 1.
Figure 1F:
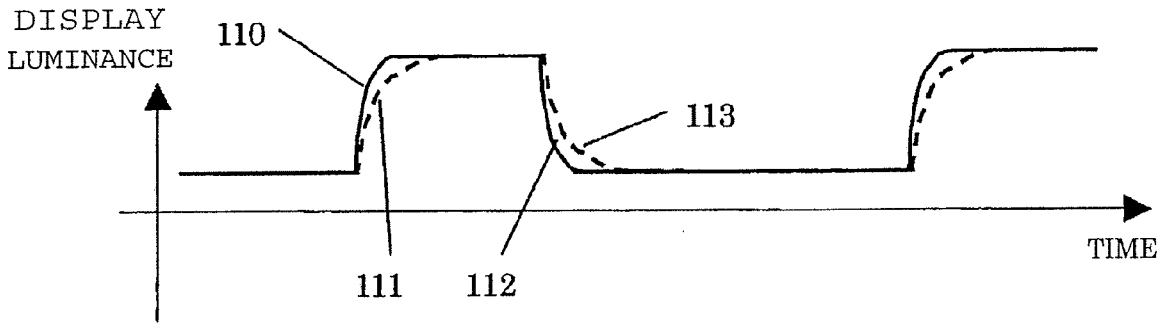
FIG. 1F illustrates an optical response characteristic in the liquid crystal display apparatus of Embodiment 1.

In order to provide tone responsivity corresponding to the absolute value of the liquid crystal applied voltage in the liquid crystal layer 204, luminance thereof changes as an optical response with the period 103 shown in FIG. 1F at which the amplitude of the liquid crystal applied voltage changes.

The alternating driving as described above can suppress the DC voltage component from being applied to the liquid crystal layer 204 to reduce occurrence of burn-in or flicker.

Furthermore, a so-called double-speed drive in which the scanning frequency for inverting the positive and negative electric fields is increased to 120 Hz can suppress, even when the flicker occurs, a human being from visually recognizing the flicker.

This embodiment performs the field inversion drive in which one field image is first written by one of the positive and negative liquid crystal applied voltages and next one field image is written by the other of the positive and negative liquid crystal applied voltages. In the field inversion drive, adjacent pixels and adjacent pixel lines in the pixel electrodes 205 have an identical polarity.

In first control in this embodiment, as shown in FIG. 1B, the positive liquid crystal applied voltage is first used to write one field image, and then the negative liquid crystal applied voltage is used to write next one field image. Further, when each field image is written by the positive liquid crystal applied voltage, as shown in FIG. 1C, an overdrive amount (voltage) 105 or 107 (which will be described later) is added to the positive liquid crystal applied voltage. Hereinafter, such control will be called as first overdrive control (a first drive mode).

In second control, as shown in FIG. 1D, the negative liquid crystal applied voltage is first used to write one field image, and then the positive liquid crystal applied voltage is used to write next one field image. Further, when each field image is written by the negative liquid crystal applied voltage, as shown in FIG. BE, an overdrive amount (voltage) 108 or 109 is added to the negative liquid crystal applied voltage. Hereinafter, such control will be called as second overdrive control (a second drive mode).

Both of the first overdrive control and the second overdrive control provide the same optical responsivity of the liquid crystal layer 204.

Next, description will be made of the principle of the overdrive of the liquid crystal modulation element 200 performed in this embodiment. As shown in FIGS. 1B and 1D, when the field inversion drive is performed without performing the overdrive, the resultant optical response waveform including dull portions 111 and 113 compared to portions 110 and 112 included in a waveform closer to an ideal waveform is obtained. Specifically, the tone of the liquid crystal modulation element 200 gently changes with a certain time constant for the change of the tone value of the input image signal. The dull change in the luminance reflects the time constant of the liquid crystal response time and causes a blurred motion to be visually recognized in moving image display.

In contrast, the overdrive uses the liquid crystal applied voltage having the waveform shown in FIGS. 1C and 1E. For example, when the tone value increases before and after the switching of the field (frame) as shown in FIG. 1C, the liquid crystal applied voltage 104*a* in the field immediately after the switching of the field is set to be higher than a liquid crystal applied voltage 104*b* corresponding to the original display tone value by a voltage 105. As a result, the optical responsivity (display luminance) of the liquid crystal layer 204 sharply rises as shown by the waveform 110, thus reducing the blur in the moving image display.

When the tone value decreases before and after the switching of the field (frame), the liquid crystal applied voltage 106*a* in the field immediately after the switching of the field is set to be lower than a liquid crystal applied voltage 106*b* corresponding to the original display tone value by a voltage 107. As a result, the optical responsivity of the liquid crystal layer 204 sharply falls as shown in the waveform 112, thus reducing the blur in the moving image display.

In the following description, the amount of the voltage increased or decreased by the overdrive for the liquid crystal applied voltage corresponding to the original display tone value is referred to as the overdrive amount. As described above, the first overdrive control causes the overdrive amounts 105 and 107 to be included in the positive liquid crystal applied voltage. The second overdrive control causes the overdrive amounts 108 and 109 to be included in the negative liquid crystal applied voltage.

The first overdrive control can be restated as a drive method for controlling the electric potential difference applied to the liquid crystal layer such that one of an absolute value of a time-integrated value of the positive electric field applied to the liquid crystal layer and an absolute value of a time-integrated value of the negative electric field applied thereto is larger than the other. In contrast, the second overdrive control can be restated as a drive method for controlling the electric potential difference applied to the liquid crystal layer such that the other absolute value of the time-integrated value is larger than the one absolute value of the time-integrated value. The above expression that one or the other of the absolute values of the time-integrated values of the positive and negative electric fields is larger than the other or the one absolute value of the time-integrated value can be restated that the these absolute values of the time-integrated values are asymmetric to each other.

Figure 7A:
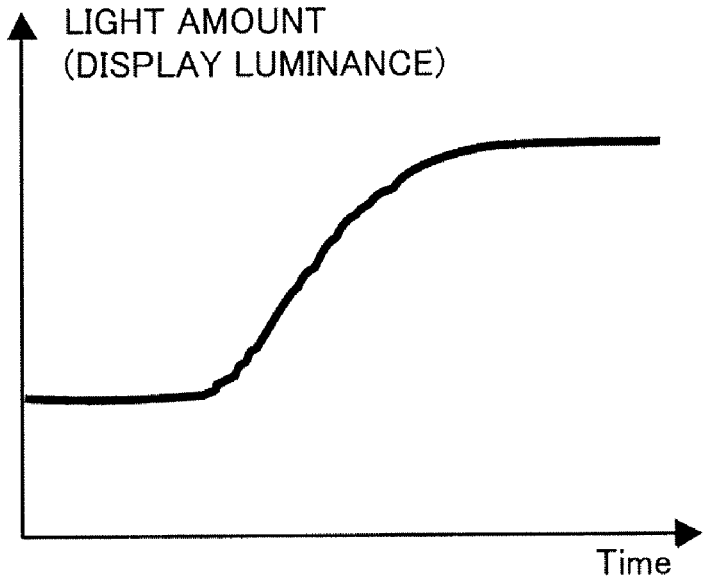
FIG. 7A illustrates the optical response characteristic of the liquid crystal display apparatus when the overdrive amount is 0.
Figure 7B:
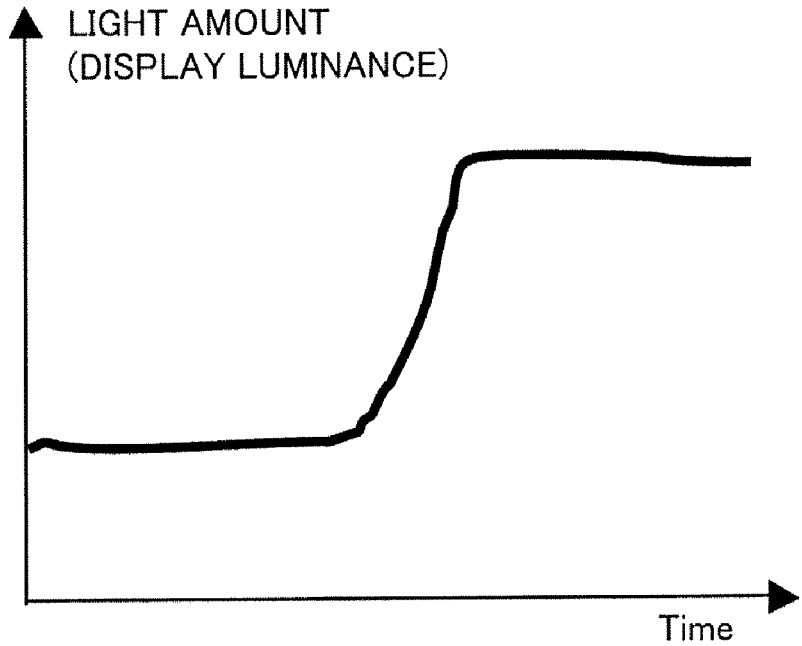
FIG. 7B illustrates the optical response characteristic of the liquid crystal display apparatus when the overdrive amount is appropriately set.
Figure 7C:
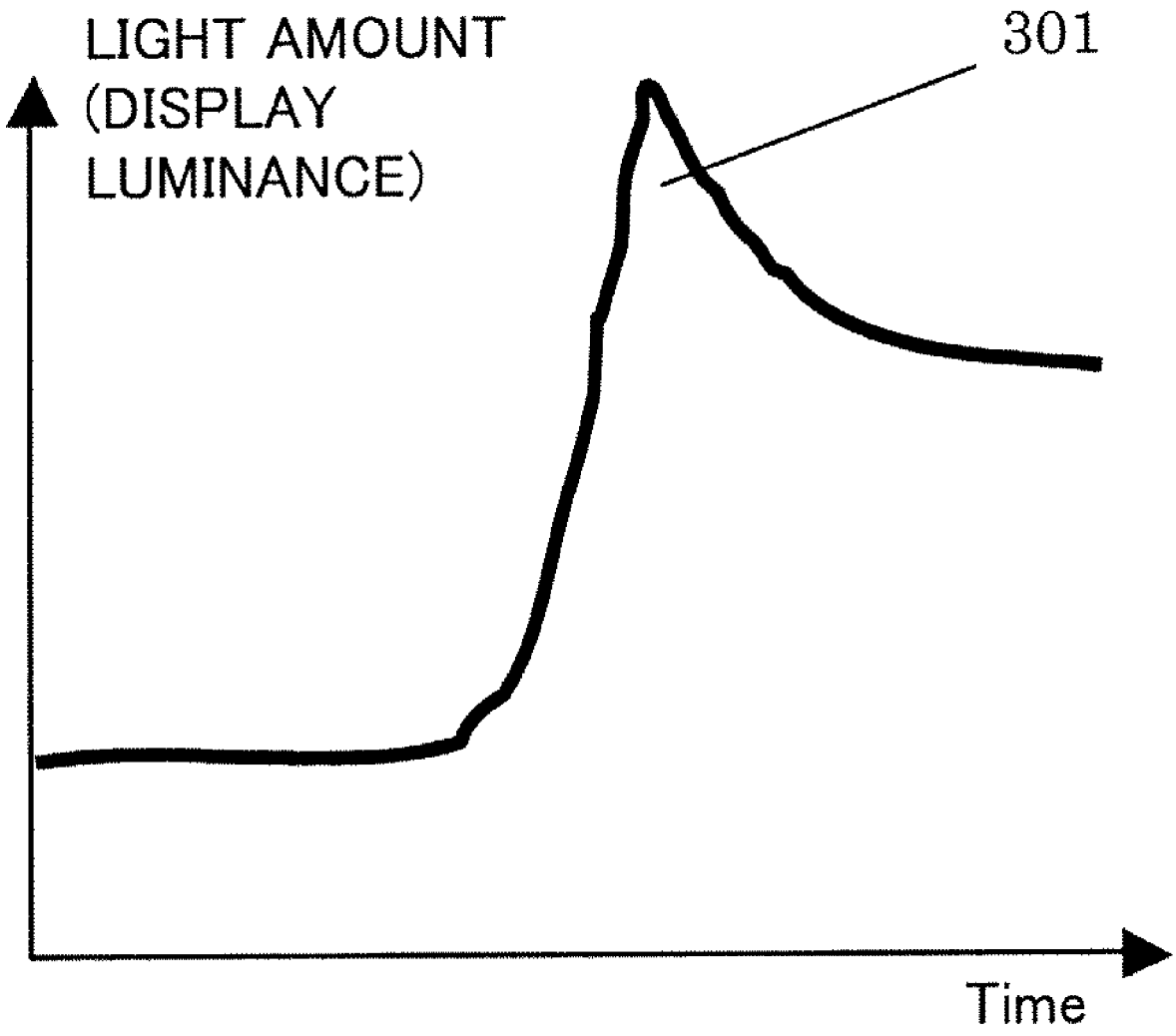
FIG. 7C illustrates the optical response characteristic of the liquid crystal display apparatus when the overdrive amount is excessively set.

The overdrive amount has an individual and appropriate value in accordance with a combination of the tone changes. FIGS. 7A to 7C respectively show an effect provided by the overdrive to the optical responsivity of the liquid crystal layer 204 when the tone rises from the black display state to the halftone display state. In these figures, the horizontal axis represents time and the vertical axis represents a display light amount (display luminance) as the optical responsivity of the liquid crystal modulation element 200.

FIG. 7A shows the display luminance when the overdrive amount is 0. FIG. 7B shows the display luminance when the overdrive amount has an appropriate value. FIG. 7C shows the display luminance when the overdrive amount is excessive.

In the case where the overdrive amount is appropriate as shown in FIG. 7B, the display luminance rises sharply, compared to the case where the overdrive amount is 0 as shown in FIG. 7A. However, in the case where the overdrive amount is excessive as shown in FIG. 7C, an overshoot 301 of the display luminance is generated. In such a case, the contour of an object in the displayed image is unnaturally emphasized. Thus, it is desirable to select an appropriate overdrive amount that prevents the overshoot of the display luminance while effectively achieving the effect of the overdrive. This appropriate overdrive amount has different values in accordance with a combination of the tone changes.

Figure 3:
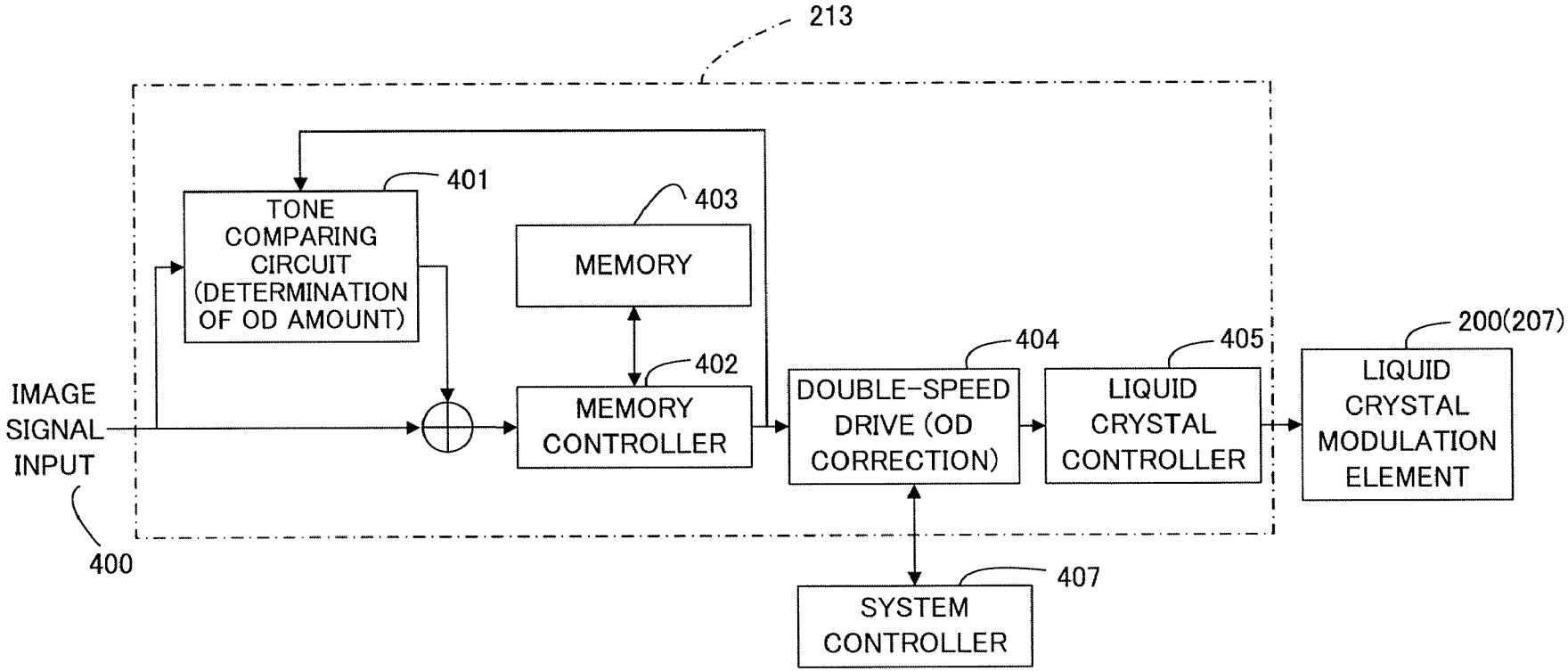
FIG. 3 is a block diagram illustrating the configuration of a control system in Embodiment 1.

Next, the configuration of the control circuit 213 that performs the first overdrive control and the second overdrive control will be described with reference to FIG. 3. In FIG. 3, the DC voltage output circuit 212 shown in FIG. 1 is omitted.

The image signal 400 input from the image supply apparatus 500 shown in FIG. 1 is output to a memory controller 402. At this point, the image signal for one frame is held in a memory 403 for one frame period. After that, the image signal held in the memory 403 is input to a tone comparing circuit 401 with timing delayed by one frame period.

The tone comparing circuit 401 receives the delayed image signal from the memory 403 and the current image signal from the image supply apparatus 500. Then, the tone values of the corresponding pixels in the continuous image signals for two frames are sequentially compared to determine the overdrive amount. The information on the overdrive amount is added as a flag to an end of the current image signal and is used for correction of the drive voltage for the overdrive, that is, setting of the liquid crystal applied voltage including the overdrive amount (hereinafter also referred to as overdrive correction of the liquid crystal applied voltage) at the subsequent stage.

The image signal having the flag of the overdrive amount is input to a double-speed drive conversion circuit 404. Herein, one frame period of the image signal of 60 Hz is divided into fields corresponding to the double speed. The image signal is converted, based on the information on the overdrive amount, into a digital signal having tone information subjected to the overdrive (OD) correction, shown in FIG. 1C or 1E. Thereafter, a liquid crystal controller 405 outputs a control signal to the liquid crystal modulation element 200 (that is, the electrode scan circuit 207) so that the liquid crystal applied voltage shown in FIG. 1C or 1E is applied to the liquid crystal layer 204.

A system controller 407 of the liquid crystal display apparatus performs changing of the overdrive amount, switching of the drive mode between the first overdrive control and the second overdrive control, and setting of control parameters for each overdrive control or the like. The system controller 407 and the control circuit 213 constitute a controller.

The first overdrive control performs the overdrive correction only in a positive direction at timing when the tone value of the image signal 400 increases (e.g., at timing when the liquid crystal applied voltage 104*a* shown in FIG. 1C is output). Thus, the DC voltage component in the positive direction corresponding to the overdrive amount 105 is temporarily applied to the liquid crystal layer 204.

On the other hand, the first overdrive control performs the overdrive correction only in a negative direction at timing when the tone value of the image signal decreases (e.g., at timing when the liquid crystal applied voltage 106*a* shown in FIG. 1C is output). Thus, the DC voltage component in the negative direction corresponding to the overdrive amount 107 is temporarily applied to the liquid crystal layer 204.

Continuing the application of the liquid crystal applied voltages corresponding to the two tone values shown in FIG. 1C in a switching manner by the first overdrive control causes a problem described below. Specifically, at each tone switching period, a DC voltage component having a value corresponding to the difference between the DC voltage component (105) in the positive direction and the DC voltage component (107) in the negative direction is applied to the liquid crystal layer 204. Then, if the positive-side liquid crystal applied voltage including the overdrive amounts 105 and 107 and the negative-side liquid crystal applied voltage corresponding to the original tone value are continuously unbalanced for a long time, the DC voltage component at each tone switching period is cumulatively applied to the liquid crystal layer 204.

Furthermore, when the tone value 101 shown in FIG. 1A corresponds to black, the overdrive for a decreased tone value cannot be performed, so that the DC voltage component (107) in the negative direction is 0. This further increases the DC voltage component in the positive direction cumulated at each tone switching period.

Thus, such a cumulative application of the DC voltage component in one direction must be prevented. To realize this, this embodiment performs the switching between the first overdrive control shown in FIG. 1C and the second overdrive control shown in FIG. 1E in the overdrive correction of the image signal performed by the double-speed drive conversion circuit 404. This switching is performed in accordance with a switching signal output from the system controller 407 with specific timing.

When the second overdrive control is performed, the DC voltage component in the negative direction is cumulatively applied as in the first overdrive control. However, the second overdrive control sets the DC voltage component to have an opposite sign (direction) to that in the first overdrive control. Thus, the first overdrive control and the second overdrive control performed in a switched manner can cancel out the DC voltage components applied to the liquid crystal layer in average during the use for a long time.

The switching between the first overdrive control and the second overdrive control, that is, the switching of the drive mode in the field inversion drive can be performed at the following timing.

For example, the drive mode can be switched during a blanking period from the end of writing of a certain one field image to the start of writing of the next field image. This enables image display without applying voltages having different polarities from each other to the liquid crystal layer in one field. Thus, the state can be kept in which the voltage having a fixed polarity is always applied to the adjacent pixel electrodes 205 in the liquid crystal modulation element 200.

Alternatively, after the liquid crystal display apparatus is power-on, the drive mode may be switched during a non-image display period prior to the start of image display on the liquid crystal modulation element 200. Specifically, when the first overdrive control is performed until the power is off in the previous use of the liquid crystal display apparatus, the first overdrive control is switched to the second overdrive control during the non-image display period after the power is on in the next use of the liquid crystal display apparatus.

Figure 2:
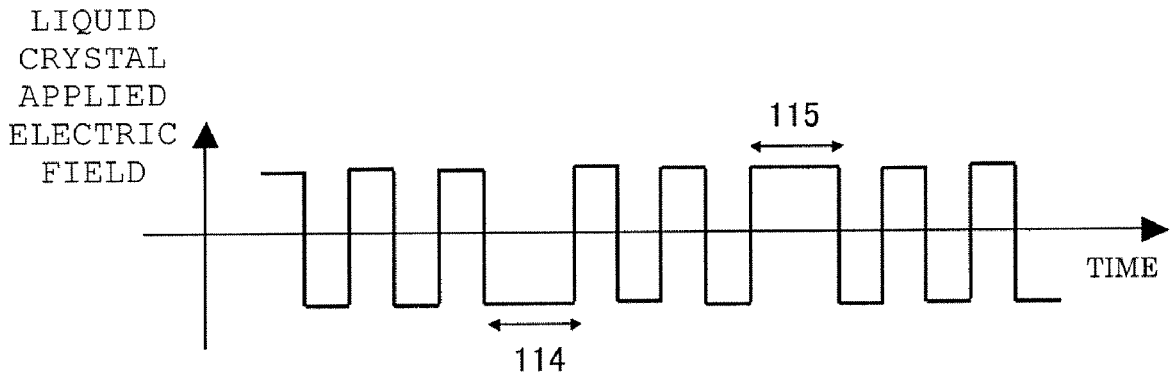
FIG. 2 illustrates a change of liquid crystal applied voltage when a drive mode is switched during normal drive.

If the drive mode is switched during the normal drive of the liquid crystal modulation element 200 in double speed inversion drive at 120 Hz, that is, during an image display period, the liquid crystal modulation element 200 is driven at 60 Hz in one frame period corresponding to the switching timing of the drive mode as shown by reference numerals 114 and 115 in FIG. 2. In general, the decrease of the driving frequency generates an unstable image or inhibits a smooth change in the moving image. Thus, the switching of the drive mode during the non-image display period and a non-image signal input period, which will be described later, can prevent such a problem from occurring.

Alternatively, the drive mode may be switched during the non-image display period in power-off processing of the liquid crystal display apparatus. Specifically, when the first overdrive control is performed until prior to the power-off in the use of the liquid crystal display apparatus, the first overdrive control is switched to the second overdrive control within the non-image display period in the power-off processing.

Alternatively, the drive mode may be switched during the non-image signal input period in which the image signal from the outside (from the image supply apparatus 500) is not input, which is a similar period to the non-image display period. When there is no input of the image signal from the outside, for example, a blue image having a low relative visibility (spectral luminous efficiency) may be displayed. Thereby, unstableness of the displayed image is unnoticeable even if the drive mode is switched.

Even when the image signal is input from the outside, the drive mode may be switched during a period in which a blue-base image suppressing the unstableness from being visually recognized is displayed.

The timing at which the drive mode is switched as described above is determined by focusing on preventing the unstableness of the displayed image due to the switching. However, the unstableness is differently visually recognized depending on the specifications of individual apparatuses such as the display luminance or the driving frequency thereof. When a display with a luminance suppressed to a certain level is performed for example, the driving mode may be switched during a display period of a still image (e.g., a menu image on which modes and various parameters of the image display apparatus can be selected).

When the writing frequency (scanning frequency) of one field is higher than 120 Hz, substantially no unstableness is visually recognized even when the drive mode is switched during the normal drive. In such a case, the switching may be performed, as described above, within the blanking period from the end of the writing of one field image to the start of the writing of the next one field image.

Figure 4:
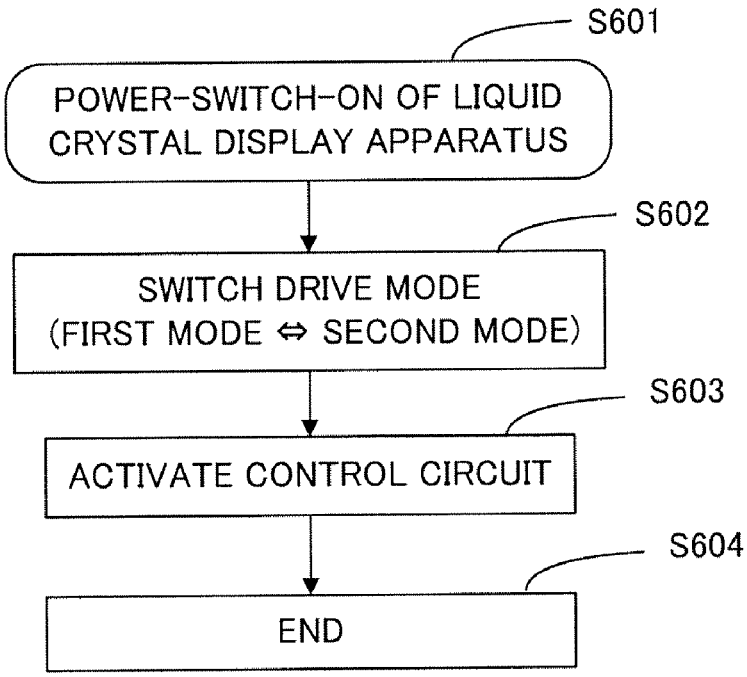
FIG. 4 is a flowchart illustrating a drive mode switching sequence in Embodiment 1.
Figure 5:
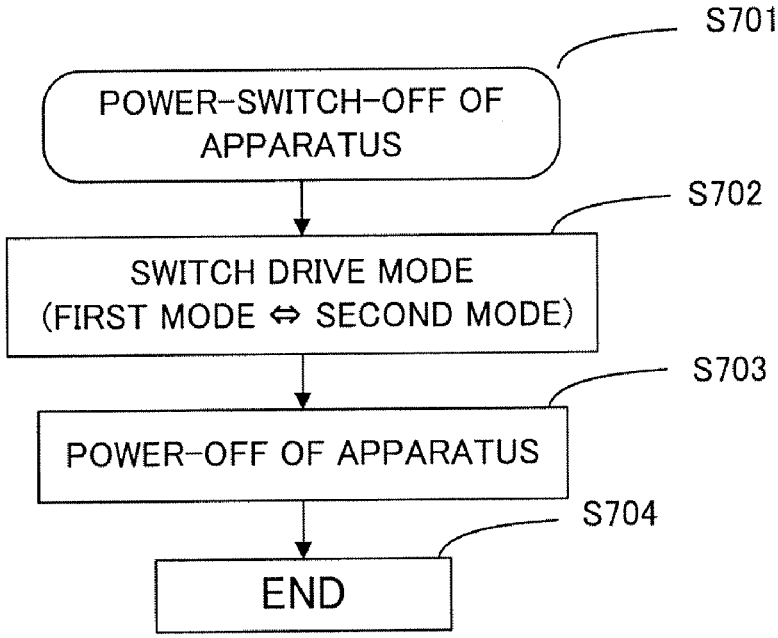
FIG. 5 is a flowchart illustrating another drive mode switching sequence in Embodiment 1.
Figure 6:
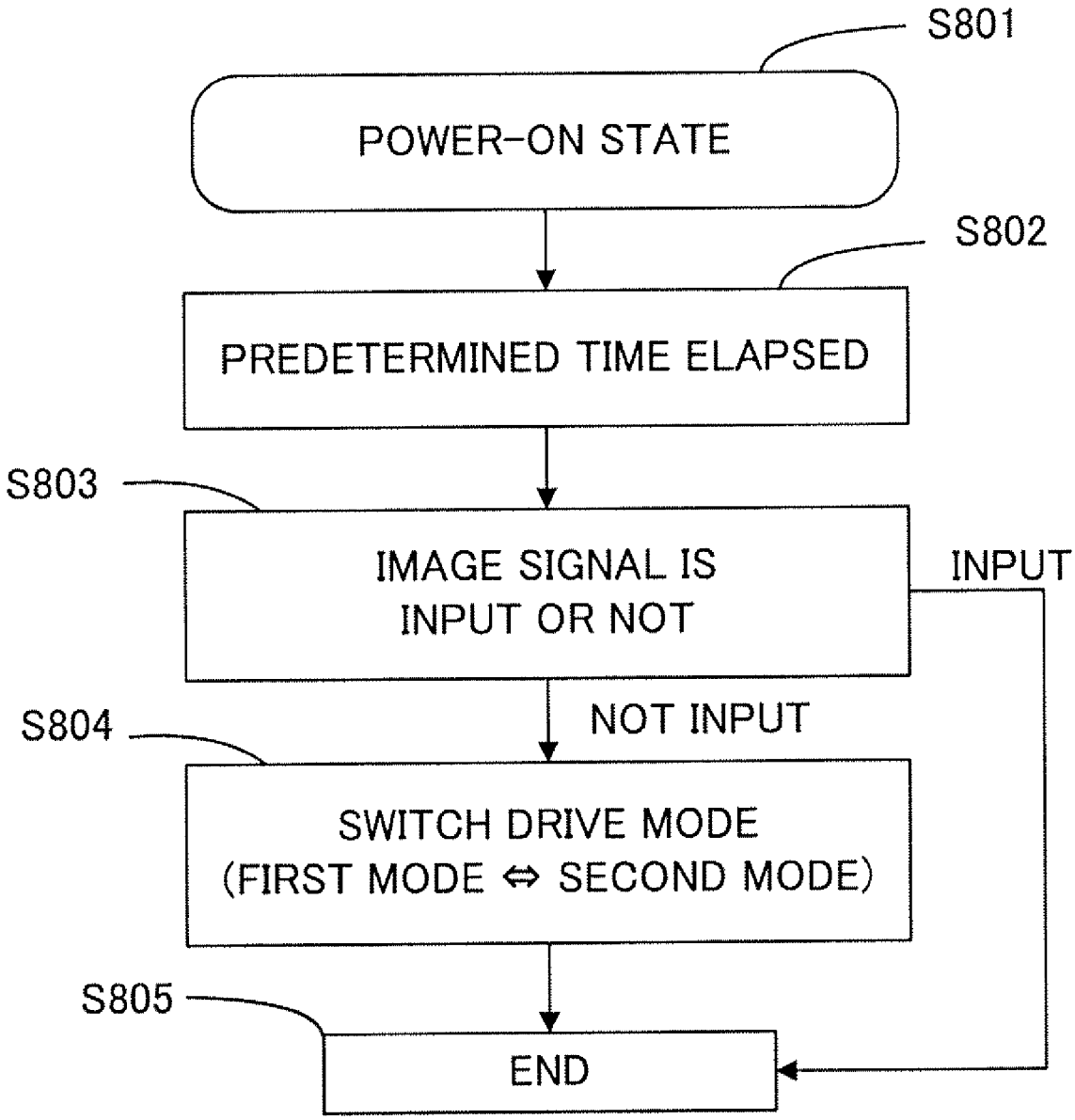
FIG. 6 is a flowchart illustrating still another drive mode switching sequence in Embodiment 1.

FIGS. 4 to 6 show flowcharts of drive mode switching operations performed by the system controller 407. These drive mode switching operations are executed based on a computer program stored in a memory (not shown) provided in the system controller 407.

FIG. 4 is a flowchart showing the operation of switching the drive mode within the above-described non-image display period at the power-on of the liquid crystal display apparatus.

At step (abbreviated as "S" in the figure) 601, the system controller 407 detects the power-on of the liquid crystal display apparatus.

At step 602, the system controller 407 switches the drive mode between the first overdrive control and the second overdrive control. The system controller 407 stores the drive mode used until prior to the switching in a nonvolatile memory (not shown) provided in the system controller 407. Then, the system controller 407 sets at this step, a drive mode different from the drive mode stored in the nonvolatile memory.

At step 603, the system controller 407 activates the control circuit 213 to cause the liquid crystal modulation element 200 to display images with the drive mode selected in the switching at step 602. Then, at step 604, the system controller 407 completes this operation.

FIG. 5 is a flowchart showing the operation of switching the drive mode during the above-described non-image display period in the power-off processing of the liquid crystal display apparatus.

At step 701, the system controller 407 detects an off operation of a power-off switch provided in the liquid crystal display apparatus. The system controller 407 stops the operation of the control circuit 213 to cause the liquid crystal modulation element 200 to enter into the no-image-display state.

At step 702, the system controller 407 stores the drive mode used until prior to the switching in the nonvolatile memory provided in the system controller 407. Then, the system controller 407 sets at this step a drive mode different from the drive mode stored in the nonvolatile memory. The set drive mode is effective after the next power-on of the liquid crystal display apparatus.

At step 703, the system controller 407 shuts off the power of the entire liquid crystal display apparatus. Then, at step 704, the system controller 407 completes this operation.

FIG. 6 is a flowchart showing the operation of switching the drive mode during the above-described non-image signal input period.

At step 801, the system controller 407 checks that the liquid crystal display apparatus is in the power-on state.

At step 802, the system controller 407 determines whether or not a count time in a timer that counts the operation time (use time) of the liquid crystal display apparatus has reached a predetermined time. If the count time has reached the predetermined time, the system controller 407 proceeds to step 803. If the count time has not reached the predetermined time, the counting by the timer is continued.

At step 803, the system controller 407 determines whether or not the image signal from the outside is input. If the image signal is not input, controller 407 proceeds to step 804 to switch the drive mode. The system controller 407 stores the drive mode used until prior to the switching in the nonvolatile memory provided in the system controller 407. Then, the system controller 407 sets at this step a drive mode different from the drive mode stored in the nonvolatile memory.

If the image signal is input at step 803, the system controller 407 proceeds to step 805 without switching the drive mode.

Then, at step 805, the system controller 407 completes this operation

The above embodiment exemplarily described the case where the liquid crystal modulation element is subjected to the overdrive. However, another liquid crystal drive method has been recently proposed in which the absolute values of the time-integrated values of the positive and negative electric fields applied to the liquid crystal layer are asymmetric with each other (e.g., N. Kimura et al.: SID 05 DIGEST, 60.2). Liquid crystal display apparatuses using such a drive method that is so-called a positive/negative asymmetric drive method are also included in embodiments of the present invention, in addition to the liquid crystal display apparatus driven by the overdrive method. The switching of drive mode in the positive/negative asymmetric drive method can reduce a risk of the above-described burn-in or the like due to a long-time driving with the asymmetric positive and negative electric fields.

Further, the above embodiment described the case where the field inversion drive is performed. However, the line inversion drive and the dot inversion drive can provide the same effects as that described in the above embodiment. Thus, the present invention is not limited to only a case where the field inversion drive is performed.

Embodiment 2

Figure 9:
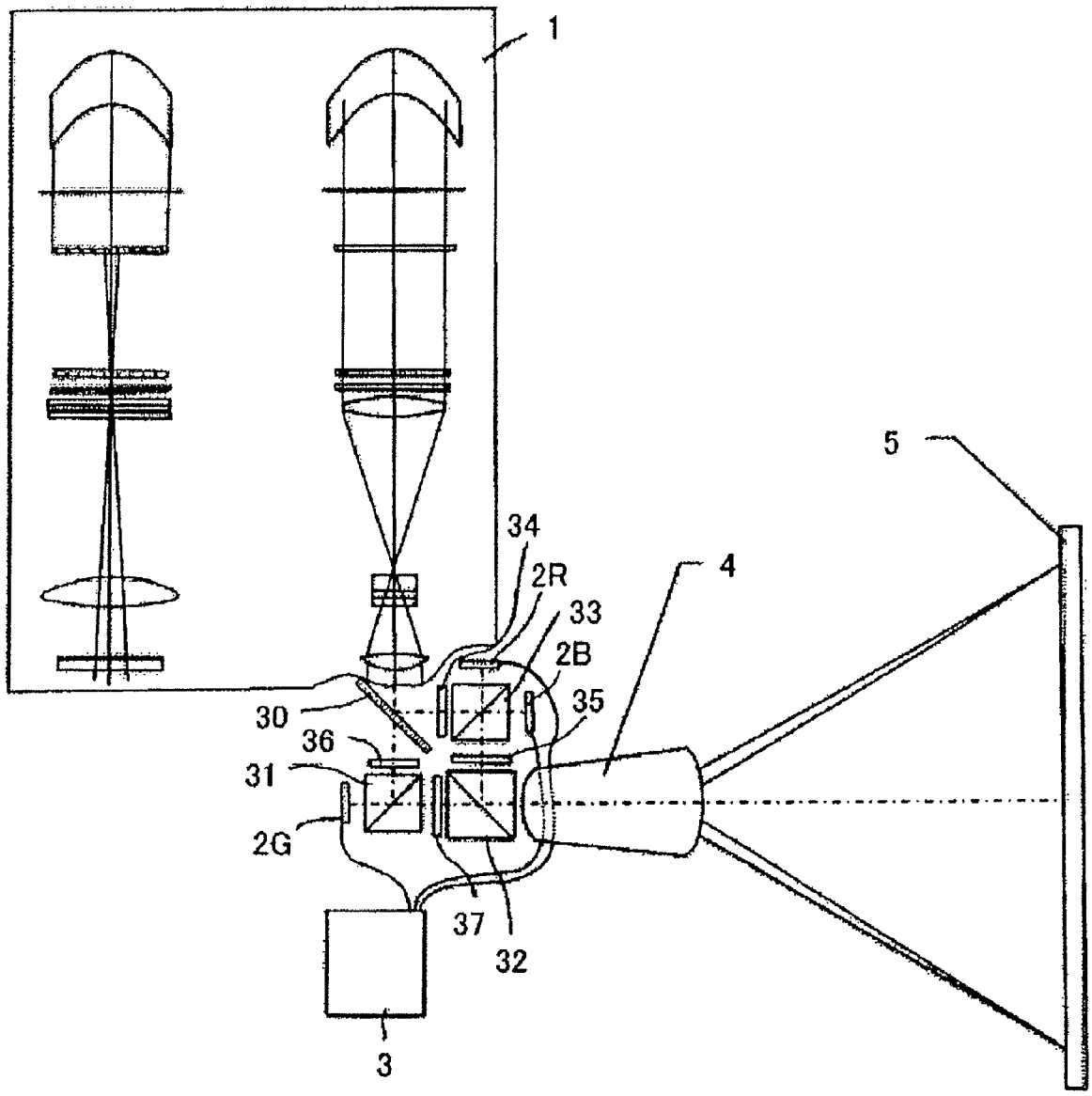
FIG. 9 illustrates the configuration of a liquid crystal projector that is a second embodiment (Embodiment 2) of the present invention.

FIG. 9 shows a liquid crystal projector (image projection apparatus) that is an example of the liquid crystal display apparatus described in Embodiment 1. FIG. 9 is a plane view (partially a side view) showing the optical configuration of the projector.

Reference numeral 3 shows a liquid crystal panel driver having functions of the control circuit 213, the DC voltage output circuit 212, the electrode scanning circuit 207 and the system controller 407, shown in FIGS. 3 and 8. The liquid crystal panel driver 3 converts image information input from the image supply apparatus 500 shown in FIG. 3 into panel driving signals for red, green and blue.

The panel driving signals for red, green and blue are input to a red liquid crystal panel 2R, a green liquid crystal panel 2G and a blue liquid crystal panel 2B, respectively. Thereby, the three liquid crystal panels 2R, 2G and 2B are driven independently from each other. Each liquid crystal panel is a reflective liquid crystal modulation element.

Reference numeral 1 shows an illumination optical system. The plane view of the illumination optical system 1 is shown on the left in the frame in the figure, and the side view thereof is shown on the right. The illumination optical system 1 includes a light source lamp, a parabolic reflector, a fly-eye lens, a polarization conversion element, a condenser lens and the like, and emits illumination light as linearly polarized light (S-polarized light) with the same polarization direction.

The illumination light from the illumination optical system 1 impinges on a dichroic mirror 30 which reflects light of magenta color and transmits light of green color. The magenta component of the illumination light is reflected by the dichroic mirror 30 and then transmitted through a blue cross color polarizer 34 which provides a half-wave retardation to polarized light of blue color. Thereby, linearly polarized light (P-polarized light with a polarization direction parallel to the sheet of the figure) of blue color and linearly polarized light (S-polarized light with a polarization direction orthogonal to the sheet) of red color are generated.

The P-polarized light of blue color enters a first polarization beam splitter 33 and is then transmitted through its polarization splitting film to reach the blue liquid crystal panel 2B. The S-polarized light of red color is reflected by the polarization splitting film of the first polarization beam splitter 33 to reach the red liquid crystal panel 2R.

S-polarized light of green color transmitted through the dichroic mirror 30 is transmitted through a dummy glass 36 for correcting the optical path length of green color and then enters a second polarization beam splitter 31. The S-polarized light of green color is reflected by the polarization splitting film of the second polarization beam splitter 31 to reach the green liquid crystal panel 2G.

As described above, the red, green and blue liquid crystal panels 2R, 2G and 2B are illuminated with the illumination light.

The light that entered each liquid crystal panel is provided with a retardation of polarization depending on the modulation state of pixels arranged in the liquid crystal panel and reflected by the liquid crystal panel to emerge therefrom. Of the reflected light, the polarized light component with the same polarization direction as that of the illumination light travels backward on the optical path of the illumination light to return to the illumination optical system 1.

On the other hand, of the reflected light, the polarized light component (modulated light) with the polarization direction orthogonal to that of the illumination light travels as follows. P-polarized light of red color modulated by the red liquid crystal panel 2R is transmitted through the polarization splitting film of the first polarization beam splitter 33. Then, the P-polarized light of red color is converted into S-polarized light by being transmitted through a red cross color polarizer 35 which provides a half-wave retardation to polarized light of red color. The S-polarized light of red color enters a third polarization beam splitter 32, reflected by its polarization splitting film and then reach a projection lens (projection optical system) 4.

S-polarized light of blue color modulated by the blue liquid crystal panel 2B is reflected by the polarization splitting film of the first polarization beam splitter 33 and then transmitted through the red cross color polarizer 35 without receiving a retardation effect to enter the third polarization beam splitter 32. The S-polarized light of blue color is reflected by the polarization splitting film of the third polarization beam splitter 32 and then reaches the projection lens 4.

P-polarized light of green color modulated by the green liquid crystal panel 2G is transmitted through the polarization splitting film of the second polarization beam splitter 31 and then transmitted through a dummy glass 37 for correcting the optical path length of green color to enter the third polarization beam splitter 32. The P-polarized light of green color is transmitted through the polarization splitting film of the third polarization beam splitter 32 and then reaches the projection lens 4.

The modulated light of three colors thus combined is projected onto a light-diffusing screen 5 that is a projection surface by the projection lens 4. Thereby, a full-color image is displayed.

The liquid crystal display apparatus described in Embodiment 1 is not limited to the liquid crystal projector of this embodiment and can be used for various display apparatuses using the liquid crystal modulation element.

As described above, according to the respective embodiments, even when the liquid crystal modulation element is driven by applying the asymmetric positive and negative electric fields to the liquid crystal layer like the overdrive, the application of the DC voltage component to the liquid crystal layer can be suppressed. Thus, a phenomenon causing a deteriorated display quality (e.g., burn-in, flicker) can be effectively suppressed.

Furthermore, the present invention is not limited to these embodiments and various variations and modifications may be made without departing from the scope of the present invention.

This application claims the benefit of Japanese Patent Application No. 2007-121661, filed on May 2, 2007, which is hereby incorporated by reference herein in its entirety.

What is claimed is:

1. A display apparatus, comprising:

a modulation element in which a liquid crystal layer is provided between a first electrode and a second electrode; and a controller configured to perform a first control mode for applying a voltage between the first and second electrodes such that, within each of plural consecutive frames of an image signal, a positive liquid crystal applied voltage is first used to write one field image, and then a negative liquid crystal applied voltage is used to write next one field image, and over drive is performed when writing the field image with the positive liquid crystal applied voltage, wherein the controller is configured to further perform a second control mode for applying a voltage between the first and second electrodes, wherein, within each of plural consecutive frames of the image signal, a negative liquid crystal applied voltage is first used to write one field image, and then a positive liquid crystal applied voltage is used to write next one field image, and overdrive is performed when writing the field image with the negative liquid crystal applied voltage, and wherein the controller controls the display apparatus to display red, green and blue image and switches between the first and second control modes during a period in which only a blue image is displayed.

2. The display apparatus according to claim 1, wherein the controller performs field inversion drive of the liquid crystal modulation element in the first control mode and the second control mode.

3. An image display system, comprising:

the display apparatus according to claim 1; and an image supply apparatus that supplies image information to the display apparatus.

4. The display apparatus according to claim 1, when there is no input of the image signal from an outside, the controller displays a blue image as a blue-base image, and the controller switches the first and second modes during a period in which the blue image is displayed.

5. The display apparatus according to claim 1, when the image signal is input from outside, the controller switches the first and second control modes during a period in which a blue-base image is displayed by the image signal from the outside.

6. The display apparatus according to claim 1, when there is no input of the image signal from an outside, the controller displays a blue image, and the controller switches the first and second modes during a period in which the blue image is displayed, and when the image signal is input from the outside, the controller switches the first and second control modes during a period in which a blue-base image is displayed.

* * * * *